US007929720B2

(12) United States Patent
Ishibashi et al.

(10) Patent No.: US 7,929,720 B2
(45) Date of Patent: Apr. 19, 2011

(54) POSITION DETECTING SYSTEM, SPEAKER SYSTEM, AND USER TERMINAL APPARATUS

(75) Inventors: Toshiaki Ishibashi, Fukuroi (JP); Takuya Tamaru, Hamamatsu (JP); Naohiro Emoto, Hamamatsu (JP)

(73) Assignee: Yamaha Corporation (JP)

( * ) Notice: Subject to any disclaimer, the term of this patent is extended or adjusted under 35 U.S.C. 154(b) by 1319 days.

(21) Appl. No.: 11/376,020

(22) Filed: Mar. 15, 2006

(65) Prior Publication Data

US 2006/0210101 A1 Sep. 21, 2006

(30) Foreign Application Priority Data

Mar. 15, 2005 (JP) ..... 2005-072480

(51) Int. Cl.
*H04R 5/02* (2006.01)

(52) U.S. Cl. ..... 381/300; 381/56; 381/58; 381/59

(58) Field of Classification Search ..... 381/300, 381/303, 307, 26, 56, 58–59, 103, 105, 109
See application file for complete search history.

(56) References Cited

U.S. PATENT DOCUMENTS

| | | | | |
|---|---|---|---|---|
| 5,386,478 | A | 1/1995 | Plunkett | |
| 6,741,273 | B1 | 5/2004 | Waters et al. | |
| 6,954,538 | B2 * | 10/2005 | Shiraishi | 381/105 |
| 7,519,187 | B2 | 4/2009 | Konagai | |
| 7,676,044 | B2 * | 3/2010 | Sasaki et al. | 381/59 |
| 2002/0136414 | A1 * | 9/2002 | Jordan et al. | 381/58 |
| 2003/0043051 | A1 | 3/2003 | Shiraishi | |

FOREIGN PATENT DOCUMENTS

| | | | |
|---|---|---|---|
| JP | 1-149694 | A | 6/1989 |
| JP | 3-196799 | A | 8/1991 |
| JP | 5-91597 | A | 4/1993 |
| JP | 5-137200 | A | 6/1993 |
| JP | 9-238390 | A | 9/1997 |
| JP | 2004363697 | A | 12/2004 |
| WO | WO 2004/014105 | A1 | 2/2004 |
| WO | 2004/066673 | A1 | 8/2004 |

OTHER PUBLICATIONS

Office Action issued in the corresponding Chinese patent application No. 200610059146.9 dated Apr. 10, 2009.
Relevant portion of European Search Report of corresponding European Application 06111025.0-2202.

* cited by examiner

*Primary Examiner* — Devona E Faulk
*Assistant Examiner* — Disler Paul
(74) *Attorney, Agent, or Firm* — Rossi, Kimms & McDowell LLP

(57) ABSTRACT

A position detecting system capable of detecting the position of a user as a listener in a simple manner. The position detecting system comprises a speaker system comprising a plurality of spatially-arranged speakers including at least a first speaker and a second speaker, a user terminal apparatus transmits a wireless signal to the speaker apparatus, and a position detecting apparatus which is provided in the side of the speaker apparatus. The position detecting apparatus computes the position of the user terminal apparatus based on a first time elapsed since the first speaker outputs a first measurement sound signal and until a receiving command transmitted by the user terminal apparatus in response to receiving the first measurement sound signal is received, and a second time elapsed since the second speaker outputs a second measurement sound signal and until a receiving command transmitted by the user terminal apparatus in response to receiving the second measurement sound signal is received.

8 Claims, 4 Drawing Sheets

POSITION DETECTING SYSTEM, SPEAKER SYSTEM, AND USER TERMINAL APPARATUS

BACKGROUND OF THE INVENTION

1. Field of the Invention

The present invention relates to a position detecting system, a speaker system, and a user terminal apparatus, and more particularly to a position detecting system which detects the position of a user as a listener in a speaker system comprised of a plurality of speakers.

2. Description of the Related Art

Conventionally, in a speaker system comprised of a plurality of speakers, the position of a user as a listener is detected, and a sound image is formed according to the detected position so that the optimum sound field can be obtained for the user. Particularly in an array speaker system, delays to be added to sound signals for input to respective speakers are controlled so as to give directivity to sounds to be output, and sound beams formed as a result are reflected on walls to form a three-dimensional sound field. Accordingly, detecting the position of a user has become increasingly important in setting suitable beam parameters which are parameters for controlling sound beams.

As an example of conventional position detecting techniques, a stereo sound restoring system disclosed in Japanese Laid-Open Patent Publication (Kokai) No. H05-091597 is constructed such that a listener carries a sound transmitting device, receiving circuits are provided close to respective ones of right and left speakers, and the listener's position is detected based upon the reception level of sound transmitted from the sound transmitting device when it is received by the receiving circuits. As another example of conventional position detecting techniques, detecting the position of a person using a plurality of special-purpose human body sensors is disclosed in Japanese Laid-Open Patent Publication (Kokai) No. H05-137200. As still another example of conventional position detecting techniques, identifying the position of a viewer by performing processing on an image picked up by a video camera is disclosed in U.S. Pat. No. 6,741,273.

The above conventional position detecting techniques, however, require installing special-purpose receiving circuits, sensor, camera, and so forth at suitable positions and also have problems described below.

According to the position detecting technique disclosed in Japanese Laid-Open Patent Publication (Kokai) No. H05-091597, the sound transmitting device to be carried by a listener is required to be equipped with a speaker for outputting sound and a power amplifier for driving the speaker. Also, the speaker is required to be equipped with a sound receiving circuit in addition to its essential speaker capability. As a result, the sound transmitting device is large-sized. According to the position detecting technique disclosed in Japanese Laid-Open Patent Publication (Kokai) No. H05-137200, when, for example, the positions of a plurality of persons are detected, complicated processing has to be performed to detect the positions of the persons since the plurality of human body sensors (infrared sensors) are used. According to the position detecting technique disclosed in U.S. Pat. No. 6,741,273, devices such as a video camera and an image processing device are needed, resulting in an increase in the costs of both hardware and software.

SUMMARY OF THE INVENTION

It is an object of the present invention to provide a position detecting system which is capable of detecting the position of a user as a listener in a simpler manner, as well as a speaker system and a user terminal apparatus.

To attain the above object, in a first aspect of the present invention, there is provided a position detecting system comprising a speaker system comprising a plurality of spatially-arranged speakers including at least a first speaker and a second speaker, and driving devices that drive respective ones of the plurality of speakers, a user terminal apparatus comprising a fist signal transmitting device that transmits a wireless signal to the speaker system, and a position detecting device provided in the side of the speaker system, and the position detecting device detecting a position of the user terminal apparatus, wherein the user terminal apparatus comprises a microphone, and a second signal transmitting device that transmits a signal to the position detecting device upon detecting that the microphone has received a sound signal from one of the plurality of speakers, and wherein the position detecting device comprises a receiving device that receives the signal transmitted from the second signal transmitting device of the user terminal apparatus, a timing device that measures a time elapsed since one of the plurality of speakers is driven and until the signal is received from the second signal transmitting device of the user terminal apparatus, and a computing device that computes the position of the user terminal apparatus based on a first time elapsed since the first speaker is driven and until a first signal transmitted by the second signal transmitting device in response to a sound signal from the first speaker is received, and a second time elapsed since the second speaker is driven and until a second signal transmitted by the second signal transmitting device in response to a sound signal from the second speaker is received.

With the arrangement of the first aspect of the present invention, the user terminal apparatus detects a sound signal generated from a speaker, and transmits a signal to the speaker system to provide notification that the sound signal has been detected. The speaker system measures the first time and the second time elapsed until sound signals from the first speaker and the second speaker, respectively, reach the user terminal apparatus, and computes the position of the user terminal apparatus based on these two times.

Preferably, the user terminal apparatus transmits a starting signal that instructs the position detecting device to start a position detecting operation to the position detecting device, and the position detecting device further comprises a driving control device that drives the first speaker upon receiving the starting signal from the user terminal apparatus.

The driving control device may drive the second speaker after receiving the first signal from the user terminal apparatus.

Preferably, the speaker system further comprises a volume control device that controls a balance of volumes of sounds to be output from the respective ones of the plurality of speakers in accordance with the position of the user terminal apparatus.

Also preferably, the speaker system further comprises a delay control device that controls delays to be added to sound signals for input to the speakers in accordance with the position of the user terminal apparatus.

Preferably, the speaker system comprises a determining device that determines whether the position of the user terminal apparatus is appropriate, and a notifying device that generates a sound signal via at least one of the speakers based upon a result of the determination by the determining device.

More preferably, the user terminal apparatus further comprises a display device operable upon detecting a sound signal generated by the notifying device, to produce a screen display based upon the sound signal.

To attain the above object, in a second aspect of the present invention, there is provided a speaker system comprising a plurality of spatially-arranged speakers including at least a first speaker and a second speaker, driving devices that drive respective ones of the plurality of speakers, a receiving device that receives a signal transmitted from a user terminal apparatus, a timing device that measures a time elapsed since one of the plurality of speakers is driven and until the signal is received from the user terminal apparatus, and a computing device that computes the position of the user terminal apparatus based on a first time elapsed since the first speaker is driven and until a first signal transmitted by the user terminal apparatus in response to a sound signal from the first speaker is received, and a second time elapsed since the second speaker is driven and until a second signal transmitted by the user terminal apparatus in response to a sound signal from the second speaker is received.

To attain the above object, in a third aspect of the present invention, there is provided a user terminal apparatus comprising a microphone, and a signal transmitting device that transmits a signal to a speaker system upon detecting a first sound signal from one of a plurality of spatially-arranged speakers constituting the speaker system.

Preferably, the user terminal apparatus further comprises a display device operable upon detecting a second sound signal from at least one of the speakers, to produce a screen display based upon the sound signal.

According to the present invention, the position of a user as a listener can be detected, automatically, in a simpler manner without the necessity of providing special-purpose receiving circuits, sensors, and so forth for position detection.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
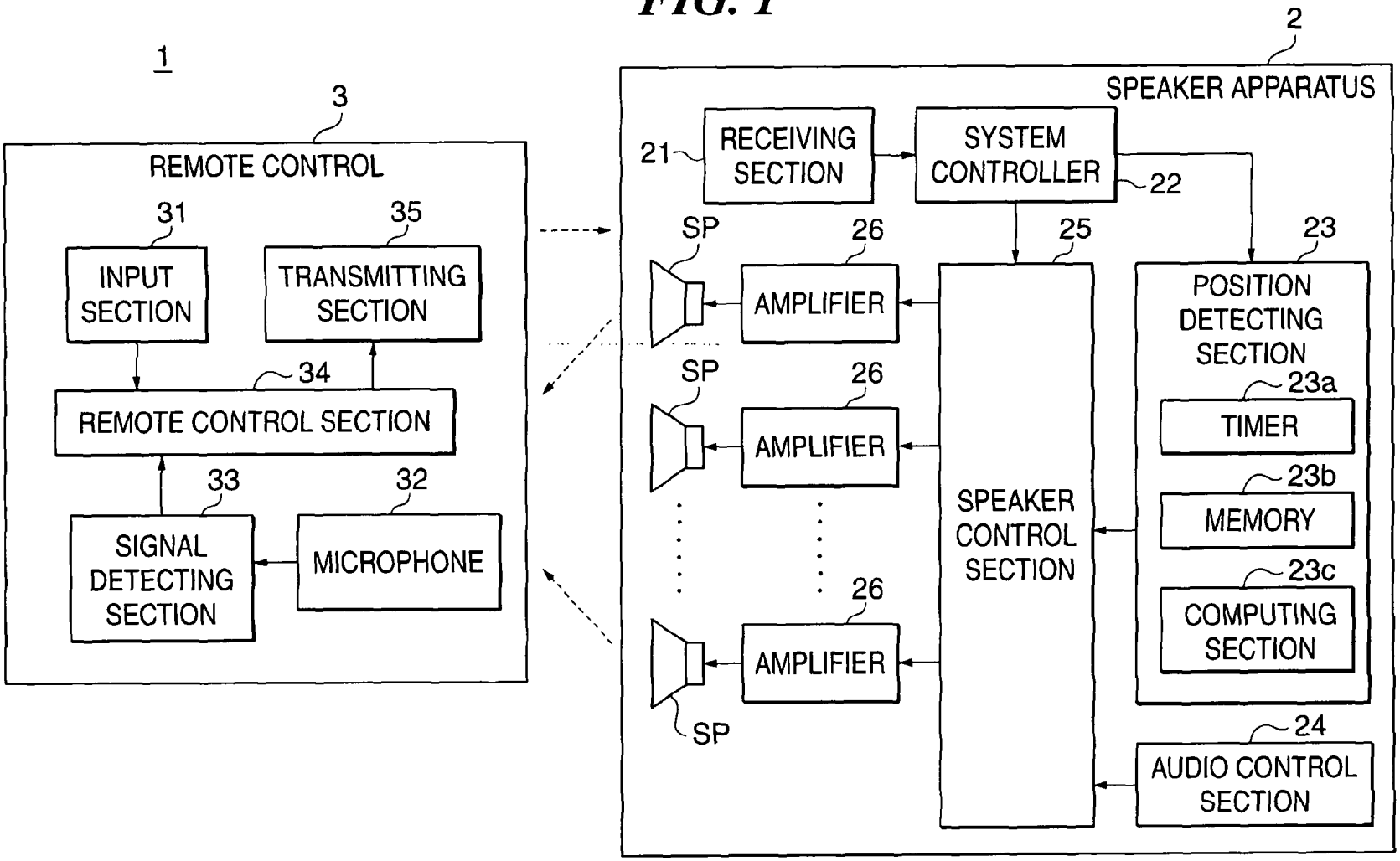
FIG. 1 is a block diagram showing the construction of a speaker system according to an embodiment of the present invention.

The present invention will now be described in detail with reference to the drawings showing a preferred embodiment thereof. FIG. 1 is a block diagram showing the construction of a speaker system according to an embodiment of the present invention. The speaker system 1 in FIG. 1 is comprised of a speaker apparatus 2 in which a plurality of speakers SP are arranged in a line and in a horizontal direction, and a remote control 3 that transmits control signals for controlling the operation of the speaker apparatus 2. The remote control 3 is implemented by, for example, a terminal apparatus that may be carried by a user.

The speaker apparatus 2 is comprised of a receiving section 21 that receives control signals from the remote control 3, a system controller 22 that controls the component elements of the speaker apparatus 2 according to the control signals received by the receiving section 21, a position detecting section 23 that detects the position of the remote control 3 according to an instruction from the system controller 22, an audio control section 24 that guides sound signals into the speaker apparatus 2, and a speaker control section 25 that controls amplifiers 26 provided for respective speakers SP according to the instruction from the system controller 22 and the position of the remote control 3 detected by the position detecting section 23.

The receiving section 21, which is implemented by, for example, a known I/F device such as an infrared receiver, receives a modulated infrared signal output from the remote control 3 and inputs a control signal obtained by demodulating the infrared signal to the system controller 22.

The system controller 22 is a functional component that issues various instructions to the position detecting section 23 and the speaker control section 25 according to control signals received by the receiving section 21. For example, upon receiving a control signal that instructs volume increase/decrease, the system controller 22 causes the speaker control section 25 to adjust the volumes of the speakers SP. Also, upon receiving a control signal that requests the detection of the remote control 3's position (hereinafter referred to as "starting command"), the system controller 22 causes the position detecting section 23 and the speaker control section 25 to carry out a position detecting operation, described later.

The position detecting section 23 is comprised of a timer 23*a* that measures the elapsed time according to an instruction from the system controller 22, a memory 23*b* that stores the time measured by the timer 23*a* and programs for controlling the operation of a computing unit such as a processor, and a computing section 23*c* that computes the position of the remote control 3 based on the time stored in the memory 23*b*. The operation of the computing unit such as a processor in accordance with the programs stored in the memory 23*b* enables the computing section 23*c* to realize predetermined functions.

The audio control section 24 is a functional component that inputs sound signals, which are input from a reproducing device for reproducing recording media such as a CD (Compact Disc) and an MD (Mini Disc) and audio files such as MP3 files, to the speaker control section 25.

The speaker control section 25 is a functional component that adjusts the balance of volumes of sound signals input from the audio control section 24 by controlling the controlled amounts of the amplifiers 26 provided for the respective speakers SP and the delays to be added to sound signals for input to the respective amplifiers 26 according to an instruction from the system controller 22 and the position of the remote control 3 detected by the position detecting section 23, and causes the speakers SP to output the sound signals. Also, the speaker control section 25 causes a predetermined speaker SP to output a measurement sound signal according to an instruction from the system controller 22.

On the other hand, the remote control 3 is comprised of an input section 31 that detects an operation input from the user, a microphone 32 that detects a sound signal, a signal detecting section 33 that detects a measurement sound signal output from the speaker apparatus 2 from received-sound signals from the microphone 32, a remote control section 34 that generates a control signal to be transmitted to the speaker apparatus 2 based on the information detected by the input section 31 and the signal detecting section 33, and a transmitting section 35 that transmits an infrared signal or the like modulated according to the control signal generated by the remote control section 34.

The input section 31, which is implemented by a known user I/F device such as buttons, a touch-sensitive panel, or a pointing device, inputs information relating to a detected user's operation input to the remote control section 34.

The microphone 32, which is implemented by a known microphone, inputs a detected received-sound signal to the signal detecting section 33.

The signal detecting section 33 detects a measurement sound signal output from the speaker apparatus 2 from received-sound signals from the microphone 32 and inputs the detected sound signal to the remote control section 34.

The remote control section 34 generates a control signal for the speaker apparatus 2 based upon information relating to a user's operation input detected by the input section 31. Additionally, upon receiving a measurement sound signal from the signal detecting section 33, the remote control section 34 generates a control signal for providing notification that the measurement sound signal has been received (hereinafter referred to as "receiving command"). It should be noted that the signal detecting section 33 and the remote control section 34 may be configured as an integral unit using a device such as an LSI.

The transmitting section 35, which is implemented by a known I/F device such as an infrared-emitting device, outputs an infrared signal or the like based upon a control signal generated by the remote control section 34.

Figure 2:
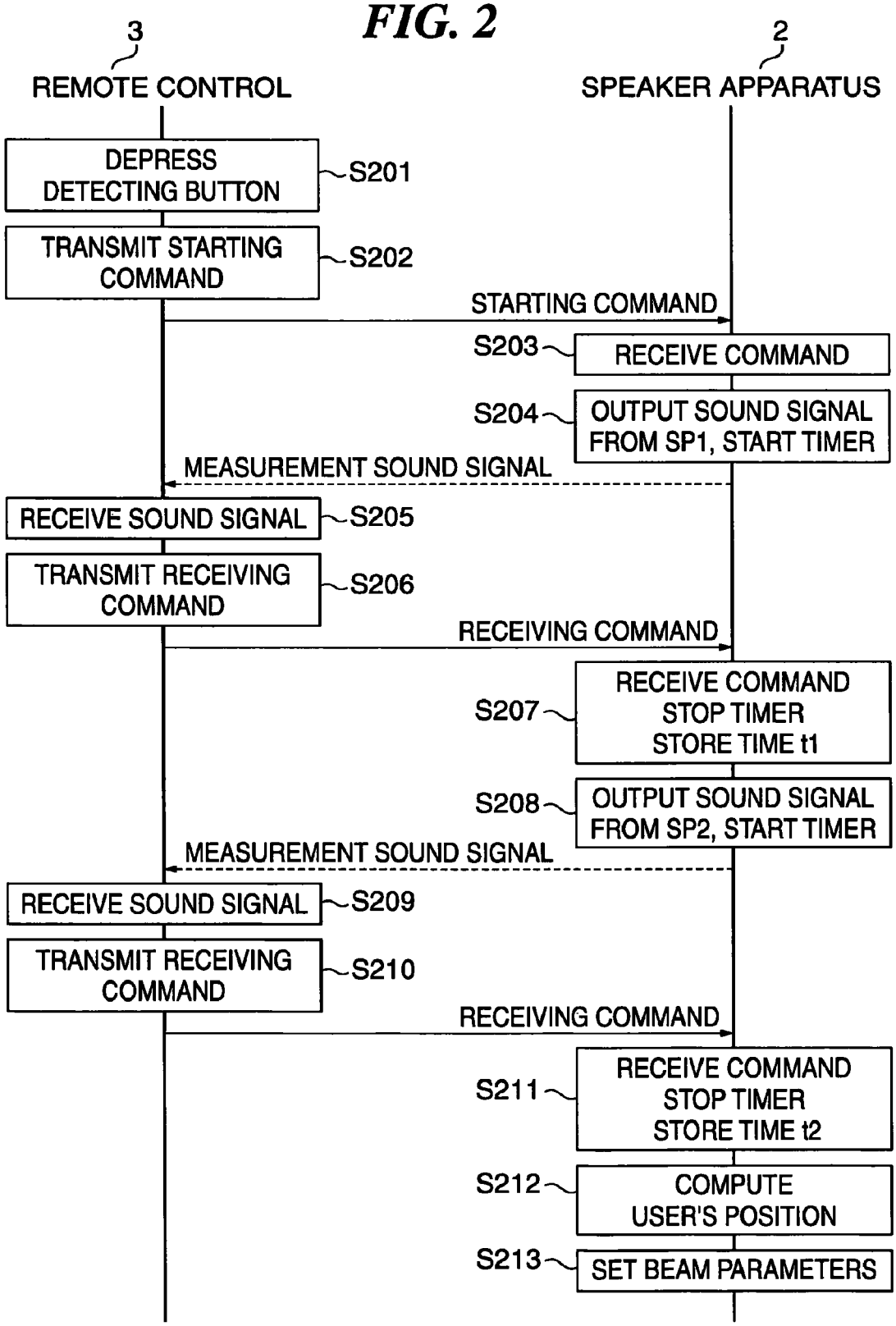
FIG. 2 is a diagram showing a position detecting sequence performed in the speaker system in FIG. 1.
Figure 3:
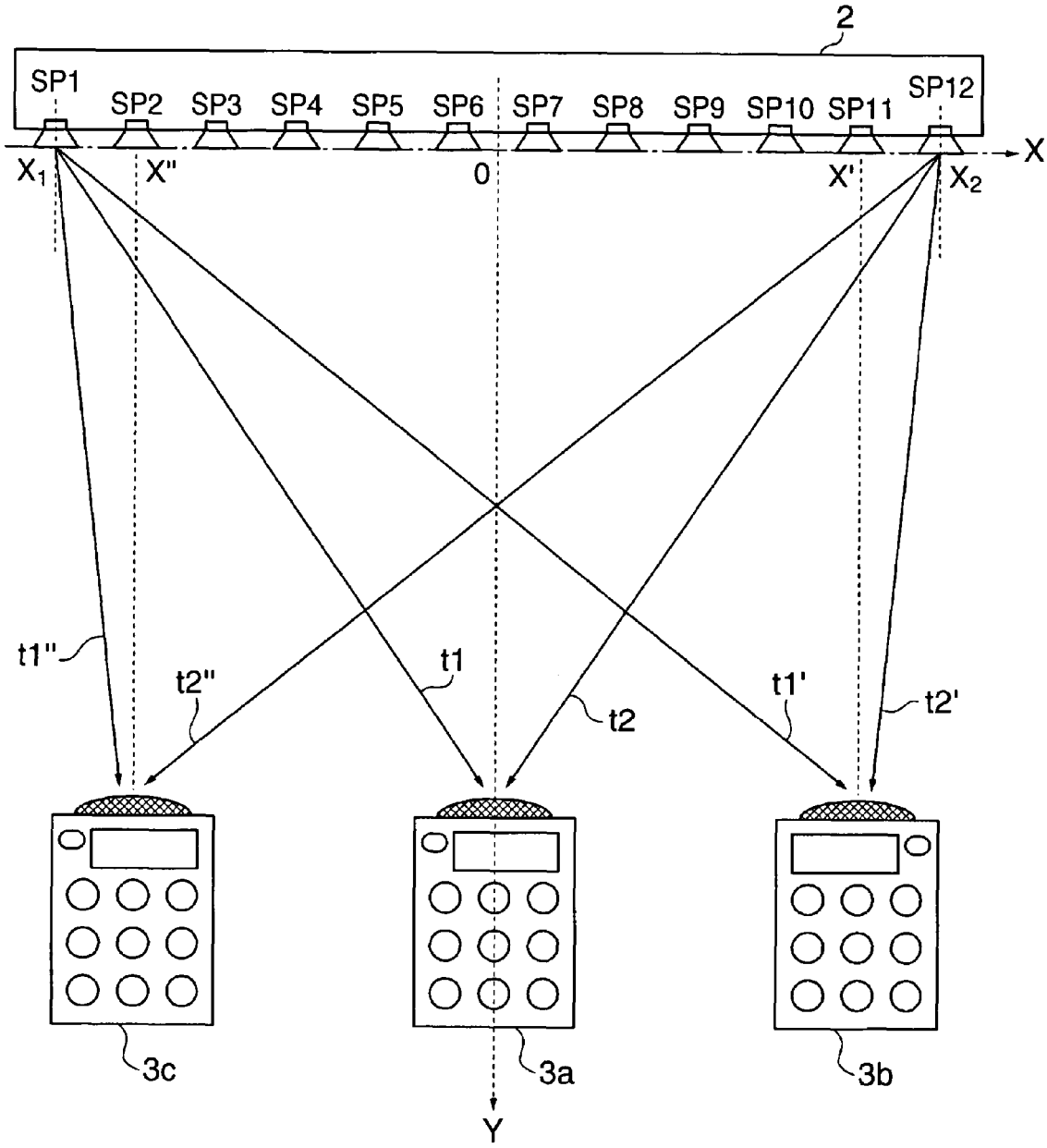
FIG. 3 is a plan view showing the positional relationship between a speaker apparatus of the speaker system in FIG. 1 and a remote control appearing in FIG. 1.

Referring next to FIGS. 2 and 3, a description will be given of how the speaker system according to the present embodiment operates in detecting the remote control's position. FIG. 2 is a diagram showing a sequence of the operation of the speaker system 1, and FIG. 3 is a diagram schematically showing the positional relationship between the speaker apparatus 2 and the remote control 3. In the present embodiment, it is assumed that 12 speakers SP1 to SP12 are arranged at predetermined intervals in a line and in a horizontal direction as shown in FIG. 3. The number of speakers SP the speaker apparatus 2 has is not limited to 12, but has only to be at least two. For the convenience of explanation, the direction in which the speakers SP are arranged is designated as an X-axis, and the direction that is perpendicular to the X-axis and parallel to the horizontal direction is designated as a Y-axis. The X-axis is positive on the speaker apparatus 2's right hand, i.e. in the direction toward the speaker SP12, and the Y-axis is positive in the direction in which sound signals are output from the speakers SP, i.e. the direction toward the user. The points of intersection of the X-axis and the Y-axis, i.e. the origin of the X-axis and the Y-axis lies in the middle of the speakers SP1 to SP12, i.e. the midsection between the speaker SP6 and the speaker SP7.

First, in the remote control 3, when the input section 31 detects an operation input from the user, which requests a position detecting operation, such as depression of a position detection starting button (step S201), the remote control section 34 generates a control signal (starting command) that instructs starting of detection of the remote control 3's position and causes the transmitting section 35 to transmit the control signal (step S202).

When the receiving section 21 of the speaker apparatus 2 receives the starting command (step S203), the system controller 22 causes the timer 23*a* of the position detecting section 23 to start measuring the time, and causes a predetermined first speaker SP (in the present embodiment, the speaker SP1 located at an end of the line in which the speakers SP1 to SP12 are arranged) to output a first measurement sound signal (hereinafter referred to as "the first measurement signal") (step S204). At this time, the speaker control section 25 may cause the speaker SP1 to output either a continuous sound signal, which is continuously output until a stopping instruction is issued, or a single-step sound signal, which is a single pulse signal, as the measurement sound signal.

When the signal detecting section 33 detects the first measurement signal, which has been output from the speaker SP1, from received-sound signals from the microphone 32 of the remote control 3 (step S205), the remote control section 34 generates a control signal (receiving command) for providing notification that the measurement sound signal has been received and causes the transmitting section 35 to transmit the control signal (step S206).

When the receiving section 21 of the speaker apparatus 2 receives the receiving command, the system controller 22 causes the timer 23*a* of the position detecting section 23 to stop measuring the time and causes the memory 23*b* to temporarily store the measured time, i.e. the first time $t_1$ elapsed until the first measurement signal reaches the remote control 3 (step S207). If the measurement sound signal is the above-mentioned continuous sound signal, upon receiving the receiving command, the system controller 22 causes the speaker SP1 to stop outputting the measurement sound signal. It should be noted that in the present embodiment, the time required for the remote control 3 to generate a control signal and transmit and receive the control signal is ignored since it is far less than the time required for the propagation of a measurement sound signal.

Next, the system controller 22 causes the timer 23*a* to start measuring the time again and causes the speaker control section 25 to output a second measurement sound signal (hereinafter referred to as "the second measurement signal") via a predetermined speaker SP (in the present embodiment, the speaker SP12 located at the other end of the line in which the speakers SP1 to SP12 are arranged) apart from the speaker SP1 (step S208).

When the signal detecting section 33 detects the second measurement signal, which is output from the speaker SP12, from received-sound signals from the microphone 32 of the remote control 3 (step S209), the remote control section 34 generates a control signal (receiving command) for providing notification that the measurement sound signal has been received and causes the transmitting section 35 to transmit the control signal (step S210).

When the receiving section 21 of the speaker apparatus 2 receives the receiving command, the system controller 22 causes the timer 23*a* of the position detecting section 23 to stop measuring the time and causes the memory 23*b* to temporarily store the measured time, i.e. the second time $t_2$ elapsed until the second measurement signal reaches the remote control 3 (step S211). If the measurement sound signal is the above-mentioned continuous sound signal, upon receiving the receiving command, the system controller 22 causes the speaker SP12 to stop outputting the measurement sound signal.

Next, the computing section 23*c* of the position detecting section 23 acquires the first time $t_1$ and the second time $t_2$ stored in the memory 23*b* and computes the position of the remote control 3 based upon the acquired first time $t_1$ and second time $t_2$ (step S212). The method of computation will now be described with reference to FIG. 3.

If the first time $t_1$ and the second time $t_2$ are equal ($t_1=t_2$), this means that the distance between the remote control 3 and the speaker SP1 and the distance between the remote control 3 and the speaker SP12 are equal. Thus, it turns out that the remote control 3 is positioned on the Y-axis in FIG. 3, i.e. at the front of the middle of the speaker apparatus 2 (the position of a remote control 3*a* appearing in FIG. 3). On this occasion, the distance y between the remote control 3 and the speaker apparatus 2 can be calculated using the following equation (1) with reference to the first time $t_1$ or the second time $t_2$, the sound velocity c, and the distance $(x_2-x_1)$ between the speaker SP1 and the speaker SP2:

$$Y = [(ct_1)^2 - \{(x_2 - x_1)/2\}^2]^{1/2} \quad (1)$$
$$= [(ct_2)^2 - \{(x_2 - x_1)/2\}^2]^{1/2}$$

where the coordinate of the speaker SP1 on the X-axis and the coordinate of the speaker SP2 on the X-axis are $x_1$ and $x_2$, respectively.

If the first time $t_1'$ is longer than the second time $t_2'$ ($t_1'>t_2'$), this means that the distance between the remote control 3 and the speaker SP1 is longer than the distance between the remote control 3 and the speaker SP12. Thus, it turns out that the remote control 3 is positioned on the speaker SP12 side of the middle of the speaker apparatus 2, i.e. on the right side of the Y-axis when FIG. 3 is viewed from front (the position of a remote control 3*b* appearing in FIG. 3). On this occasion, the coordinate x' of the remote control 3 on the X-axis and the distance y' between the remote control 3 and the speaker apparatus 2 can be calculated using the following equations (2) and (3):

$$x' = [(ct_2')^2 - (ct_1')^2 + (x_2)^2 - (x_1)^2]/[2(x_2 - x_1)] \quad (2)$$

$$y' = [(ct_1')^2 - (x_2 - x')^2]^{1/2} \quad (3)$$
$$= [(ct_2')^2 - (x' - x_1)^2]^{1/2}$$

If the first time $t_1''$ is shorter than the second time $t_2''$ ($t_1''<t_2''$), this means that the distance between the remote control 3 and the speaker SP1 is shorter than the distance between the remote control 3 and the speaker SP12. Thus, it turns out that the remote control 3 is positioned on the speaker SP1 side of the middle of the speaker apparatus 2, i.e. on the left side of the Y-axis when FIG. 3 is viewed from front (the position of a remote control 3*c* appearing in FIG. 3). On this occasion, the coordinate x" of the remote control 3 on the X-axis and the distance y" between the remote control 3 and the speaker apparatus 2 can be calculated using the following equations (4) and (5):

$$x'' = [(ct_2'')^2 - (ct_1'')^2 + (x_2)^2 - (x_1)^2]/[2(x_2 - x_1)] \quad (4)$$

$$y'' = [(ct_1'')^2 - (x_2 - x'')^2]^{1/2} \quad (5)$$
$$= [(ct_2'')^2 - (x'' - x_1)^2]^{1/2}$$

If fixed times existing in terms of the system in the first time $t_1$ ($t_1'$, $t_1''$) and the second time $t_2$ ($t_2'$, $t_2''$) are so long that it cannot be ignored as compared with the time required for the propagation of a measurement sound signal, the above computations using the equations (1) to (5) are performed after a correction is made to compensate for those times.

When the position of the remote control 3 has been detected using the above described method, the speaker control section controls the amplifiers 26 and the delays so as to obtain the optimum sound field for the detected position of the remote control 3 (step S213), and then forms a sound image. As described above, the trigger that starts the operation for detecting the position of the remote control 3 is the user's operation of the remote control 3, and therefore the position of the remote control 3 can be regarded as the user's position. Thus, by forming a sound image so as to obtain the optimum sound field for the position of the remote control 3, a sound image is formed such that the sound field is optimum for the user's position.

As described above, according to the present embodiment, by simply measuring the time elapsed until sound signals output from the speakers SP of the speaker apparatus 2 reach the remote control 3, the position of the remote control 3 can be automatically detected. This can be realized by the simple construction in which the conventional remote control 3 is additionally equipped with the microphone 32 and the signal detecting section 33 which detect measurement sound signals.

Although in the present embodiment, the position detecting operation is started in response to the depression of the position detection starting button of the remote control 3, the trigger that starts the position detecting operation is not limited to the depression of the position detecting button, but any other trigger may be arbitrarily set, such as the detection of the startup of the speaker system 1 or various user's instructions such as volume increase/decrease by the input section 31.

Further, in the present embodiment, the first measurement signal and the second measurement signal should not necessarily be identical, but may differ in sound quality and/or volume. In this case, by adapting the signal detecting section 33 to identify the first measurement signal and the second measurement signal independently, the first measurement signal and the second measurement signal can be output at the same time, and as a result, the time required to detect the position of the remote control 3 can be reduced.

Further, although in the present embodiment, the position of the remote control 3 is detected based upon measurement sound signals output from two speakers SP, the position of the remote control 3 may be detected based upon measurement sound signals output from three or more speakers SP arranged in a line. Detecting the position of the remote control 3 based upon measurement sound signals from a larger number of speakers improves detection accuracy.

Further, although in the present embodiment, the position of the remote control 3 is detected based upon two measurement sound signals, the position of the remote control 3 may be detected based upon three measurement sound signals. In this case, the speakers SP are arranged in a two-dimensional or three-dimensional form, measurement sound signals are output from three speakers SP placed at different locations, and the three-dimensional position of the remote control 3 is detected based upon the times elapsed until the respective measurement sound signals reach the remote control 3.

Figure 4:
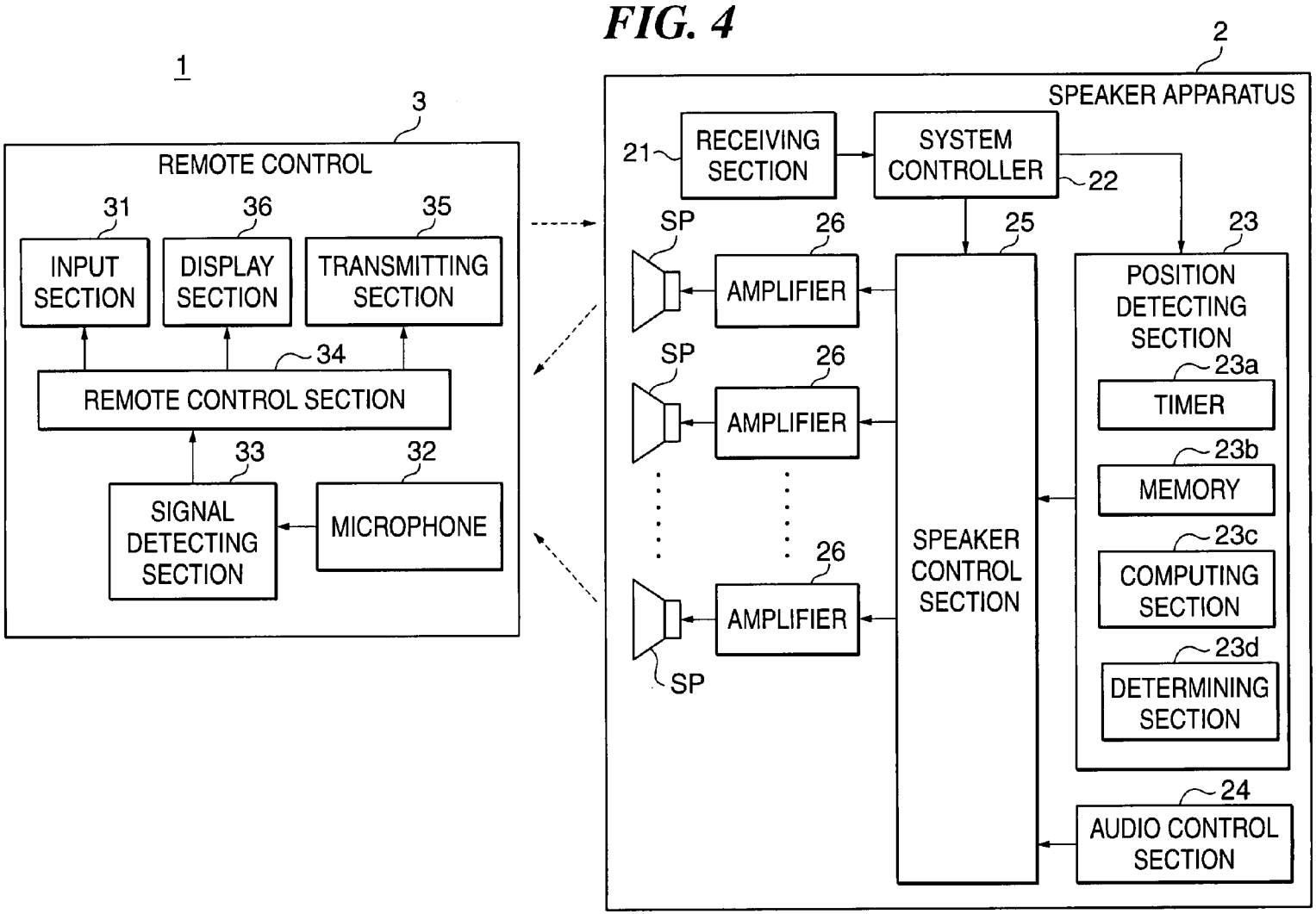
FIG. 4 is a block diagram showing a variation of the construction of the speaker system in FIG. 1.

Referring next to FIG. 4, a description will be given of a variation of the present embodiment. FIG. 4 is a block diagram showing a variation of the construction of the speaker system according to the present embodiment. It should be noted that in the speaker system in FIG. 4, component elements corresponding to those of the speaker system in FIG. 1 are denoted by the same names and reference numerals, and description thereof is omitted when appropriate.

A position detecting section 23 of a speaker apparatus 2 is comprised of a timer 23*a*, a memory 23*b* that further stores positional information relating to the appropriate range of the remote control 3's position, a computing section 23*c*, and a determining section 23*d* that determines whether the position of the remote control 3 computed by the computing section 23*c* is appropriate or not.

The remote control 3 is comprised of an input section 31, a microphone 32, a signal detecting section 33, a remote control section 34, a transmitting section 35, and a display section 36 comprised of lights such as LEDs (light emitting diodes) and a display device such as an LCD (liquid crystal display), an FED (field emission display), or an organic EL (electro luminescence) display.

In the speaker system in FIG. 4 constructed as described above, when the position of the remote control 3 has been computed by the computing section 23*c* using the above described method, the determining section 23*d* determines whether or not the position of the remote control 3 is appropriate based upon the result of computation by the computing section 23*c* and the positional information stored in the memory 23*b*. The determining section 23*d* also functions as a notifying means for notifying the user whether or not the position of the remote control 3 is appropriate as described later.

For example, in the case where the positional information stored in the memory 23*b* is comprised of two threshold values that represent the closest position and the farthest position to and from the speaker apparatus 2 in a range in which the position of the remote control 3 is determined appropriate, the determining section 23*d* compares the position of the remote control 3 computed by the computing section 23*c* with the threshold values to determine whether or not the position of the remote control 3 is appropriate. When the position of the remote control 3 lies between the two positions represented by the two threshold values, the determining section 23*d* determines that the position of the remote control 3 is appropriate. On the other hand, when the position of the remote control 3 is closer to the speaker apparatus 2 than the closest position represented by one of the threshold values, the determining section 23*d* determines that the remote control 3 is too close to the speaker apparatus 2. When the position of the remote control 3 is farther from the speaker apparatus 2 than the farthest position represented by the other one of the threshold values, the determining section 23*d* determines that the remote control 3 is too far from the speaker apparatus 2.

When the position of the remote control 3 lies in the appropriate range, the determining section 23*d* causes the speaker control section 25 to emit sound signals, which indicate that the position of the remote control 3 lies in the appropriate range, via at least one of the speakers SP after beam parameters are set in a step S213 in FIG. 2. In this case, sound signals are generated such that, for example, frequency increases in succession from a low frequency to a high frequency, i.e. low→mid→high. The low-, mid-, and high-frequency sound signals may have a band of about ⅓ octave around 250 Hz, 500 Hz, and 1 kHz, respectively.

On the other hand, when the position of the remote control 3 does not lie in the appropriate range, the determining section 23*d* causes the speaker control section 25 to emit sound signals, which indicate that the position of the remote control 3 does not lie in the appropriate range, via at least one of the speakers SP. For example, when the remote control 3 is too close to the speaker apparatus 2, sound signals are generated such that frequency increases once from a low frequency and then returns to the low frequency, i.e. low→mid→low. On the other hand, when the remote control 3 is too far from the speaker apparatus 2, sound signals are generated such that, for example, frequency decreases once from a high frequency and then returns to the high frequency, i.e. high→mid→high.

As described above, emitting sound signals varying according to the user's position enables the user to easily determine whether his/her current position lies in the appropriate range, is too close to the speaker apparatus 2, or is too far from the speaker apparatus 2.

It should be noted that sound signals should not necessarily vary according to the user's position as follows: low→mid→high, low→mid→low, and high→mid→high, but how sound signals vary may be arbitrarily determined insofar as whether the user's current position lies in the appropriate range, is too close to the speaker apparatus 2, or is too far from the speaker apparatus 2 can be determined.

Further, when the signal detecting section 33 detects sound signals for notifying the user whether or not the position of the remote control 3 is appropriate as described above from received-sound signals from the microphone 32 of the remote control 3, the remote control section 34 may cause the display section 36 to produce a screen display in accordance with the sound signals.

In this case, the signal detecting section 33 is provided with three band-pass filters corresponding to low-, mid-, and high-frequency sound signals, for detecting the order in which output sound signals vary. In accordance with the detection result, the remote control section 34 controls the display section 36. For example, where the display section 36 is comprised of blue, red, and yellow LEDs, the blue LED is lighted up when the position of the remote control 3 lies in the appropriate range, the red LED is lighted up when the remote control 3 is too close to the speaker apparatus 2, and the yellow LED is lighted up when the remote control 3 is too far from the speaker apparatus 2. This enables the user to visually recognize the situation with regard to his/her position with reference to the remote control 3 he/she holds.

It should be noted that when the display section 36 is implemented by a display device, characters such as "appropriately positioned", "too close to speakers", or "too far from speakers" may be displayed on the display section 36 according to the position of the remote control 3. This enables the user to visually recognize the situation with regard to his/her position more concretely with reference to the remote control 3 he/she holds.

What is claimed is:

1. A position detecting system comprising:

a speaker system comprising an array speaker having a plurality of speakers arranged along at least one line, including at least a first speaker and a second speaker that are separated by a known preset distance and each output a measurement sound signal, and driving devices that drive respective ones of said plurality of speakers;

a user terminal apparatus comprising a signal transmitting device that transmits a wireless signal to said speaker system, and a microphone;

a position detecting device provided in a side of said speaker system, and said position detecting device detecting a position of said user terminal apparatus, wherein said signal transmitting device transmits the wireless signal to said position detecting device upon detecting that said microphone has received the measurement sound signal from one of said at least first and second speakers, and wherein said position detecting device comprises:

a memory device storing the known preset distance between the first speaker and the second speaker;

a receiving device that receives the wireless signal transmitted from said signal transmitting device of said user terminal apparatus;

a timing device that measures a time elapsed since one of said at least first and second speakers is driven and until the wireless signal is received from said signal transmitting device of said user terminal apparatus; and a computing device that computes the position of said user terminal apparatus based on (i) a first time elapsed since said first speaker is driven and until a first wireless signal transmitted by said signal transmitting device in response to the measurement sound signal from said first speaker is received, (ii) a second time elapsed since said second speaker is driven and until a second wireless signal transmitted by said signal transmitting device in response to the measurement sound signal from said second speaker is received, and (iii) the known preset distance between the first speaker and the second speaker stored in the memory.

2. A position detecting system according to claim 1, wherein:

said user terminal apparatus transmits a starting signal that instructs said position detecting device to start a position detecting operation to said position detecting device, and said position detecting device further comprises a driving control device that drives said first speaker upon receiving the starting signal from said user terminal apparatus.

3. A position detecting system according to claim 1, wherein said speaker system further comprises a volume control device that controls a balance of volumes of sounds to be output from the respective ones of said plurality of speakers in accordance with the position of said user terminal apparatus.

4. A position detecting system according to claim 1, wherein said speaker system further comprises a delay control device that controls delays to be added to sound signals for input to said speakers in accordance with the position of said user terminal apparatus.

5. A position detecting system according to claim 1, wherein said speaker system comprises a determining device that determines whether the position of said user terminal apparatus is appropriate, and a notifying device that generates a sound signal via at least one of said speakers based upon a result of the determination by said determining device.

6. A position detecting system according to claim 5, wherein said user terminal apparatus further comprises a display device operable upon detecting a sound signal generated by said notifying device, to produce a screen display based upon the sound signal.

7. A speaker system comprising:

an array speaker having a plurality of speakers arranged in at least one line, including at least a first speaker and a second speaker that are separated by a preset known distance and each output a measurement sound signal;

driving devices that drive respective ones of said plurality of speakers;

a memory device storing the known preset distance between the first speaker and the second speaker;

a receiving device that receives a signal transmitted from a remote user terminal apparatus;

a timing device that measures a time elapsed since one of said at least first and second speakers is driven and until the signal transmitted from said user terminal apparatus is received; and a computing device that computes the position of said user terminal apparatus based on (i) a first time elapsed since said first speaker is driven and until a first signal transmitted by said user terminal apparatus in response to the measurement sound signal from said first speaker is received, (ii) a second time elapsed since said second speaker is driven and until a second signal transmitted by said user terminal apparatus in response to the measurement sound signal from said second speaker is received, and (iii) the known preset distance between the first speaker and the second speaker stored in the memory.

8. A speaker system according to claim 7, further comprising a display device operable upon detecting the measurement sound signal from at least one of the speakers, to produce a screen display based upon the measurement sound signal.

* * * * *